US005803988A

United States Patent [19]

Bae et al.

[11] Patent Number: 5,803,988

[45] Date of Patent: Sep. 8, 1998

[54] METHOD FOR MANUFACTURING NON-ORIENTED ELECTRICAL STEEL SHEET SHOWING SUPERIOR ADHERENCE OF INSULATING COATED LAYER

[75] Inventors: Byung Keun Bae; Sam Kyu Chang; Jong Soo Woo; Wun Gul Lee, all of Pohang, Rep. of Korea

[73] Assignee: Pohang Iron & Steel Co., Ltd., Pohang, Rep. of Korea

[21] Appl. No.: 894,394

[22] PCT Filed: Jun. 1, 1996

[86] PCT No.: PCT/KR96/00078

§ 371 Date: Aug. 18, 1997

§ 102(e) Date: Aug. 18, 1997

[87] PCT Pub. No.: WO97/22723

PCT Pub. Date: Jun. 26, 1997

[30] Foreign Application Priority Data

Dec. 19, 1995 [KR] Rep. of Korea ..... 1995 51874

[51] Int. Cl.[6] ..... H01F 1/147

[52] U.S. Cl. ..... 148/111; 148/120; 148/113; 148/122

[58] Field of Search ..... 148/111, 112, 148/113, 120, 121, 122

[56] References Cited

U.S. PATENT DOCUMENTS

| | | | |
|---|---|---|---|
| 3,853,971 | 12/1974 | Kato et al. | 260/901 |
| 3,930,906 | 1/1976 | Irie et al. | 148/113 |
| 4,326,899 | 4/1982 | Henricks | 148/120 |

FOREIGN PATENT DOCUMENTS

| | | |
|---|---|---|
| 60-38069 | 2/1985 | Japan . |
| 60-152628 | 8/1985 | Japan . |
| 61-231120 | 10/1986 | Japan . |
| 3223423 | 10/1991 | Japan . |

OTHER PUBLICATIONS

Japanese Abstract No. 60–38069, Feb. 27, 1985, 1 p., (English language).

Japanese Abstract No. 60–152628, Aug. 10, 1985. 1 p., (English language).

Japanese Abstract No. 61–231120, Oct. 15, 1986, 1 p., (English language).

Japanese Abstract No. 3–223423, Oct. 2, 1991, 1 p., (English language).

*Primary Examiner*—John Sheehan

*Attorney, Agent, or Firm*—Webb Ziesenheim Bruening Logsdon Orkin & Hanson, P.C.

[57] ABSTRACT

The annealing conditions of a cold rolled steel sheet are properly controlled so as to form a dense surface oxide layer, thereby improving the adherence strength of the insulating layer on non-oriented electrical steel sheet. The method includes the following steps. A steel slab is prepared which is composed of in weight %: 0.05% or less of C, 3.5% or less of Si, 1.5% or less of Mn, 0.15% or less of P, 0.015% or less of S, 1.0% or less of Al, one or more elements selected from a group consisting of 0.03–0.30% of Sn, 0.03–0.3% of Sb, 0.03–1.0% of Ni and 0.03–0.50% of Cu, the balance of Fe and unavoidable impurities. The steel slab is reheated, hot rolled, pickled after annealing or without annealing and cold-rolled. A low temperature annealing is carried out on the cold rolled steel sheet at a temperature of 750°–850° C. for 30 seconds to 5 minutes under a humid atmosphere having a dew point of 25°–65° C. A high temperature annealing is carried out on the low-temperature-annealed cold rolled steel sheet at a temperature of 800°–1070° C. for 10 seconds to 3 minutes under a dry atmosphere having a dew point of 0° C. or below. Insulating layers are coated on the surfaces of the high-temperature-annealed steel sheet, and a hardening heat treatment is carried out on the steel sheet.

4 Claims, No Drawings

METHOD FOR MANUFACTURING NON-ORIENTED ELECTRICAL STEEL SHEET SHOWING SUPERIOR ADHERENCE OF INSULATING COATED LAYER

BACKGROUND OF THE INVENTION

1. Field of the Invention

The present invention relates to a method for manufacturing an non-oriented electrical steel sheet which is used as steel cores for electrical machines such as electric motors, electric generators, small transformers and the like. More specifically, the present invention relates to a method for manufacturing an non-oriented electrical steel sheet showing a superior adherence of the insulating coated layer.

2. Description of the Prior Art

The non-oriented electrical steel sheet is used as a steel core for electrical machines such as electric motors, electric generators, transformers and the like. This steel core is generally manufactured by press-punching electrical steel sheets and by stacking them.

In the case where the steel core is manufactured by stacking, each sheet is coated with an insulating layer so as to insulate each sheet, thereby reducing the eddy currents.

Generally, the iron loss of the non-oriented electrical steel sheet consists of eddy current loss and hysteresis loss, and this iron loss can be measured in the unit of watts.

The major factors which influence the eddy current are the electric insulation property of the insulating coated layer, the thickness of the steel sheets, and their composition.

Particularly, in the case where an energy saving is required, or where it is used as a core of high frequency products, it is absolutely necessary to reduce eddy current.

Meanwhile, the insulating coated layer which is coated on the surface of the electrical steel sheet is classified into an organic coating material, an inorganic coating material and an organic-inorganic composite coating material. If the thickness of the insulating layer is increased, the insulating current value is lowered.

If iron loss, particularly eddy current loss, is to be decreased, the insulating layer should be firmly adhered on the surface of the steel sheet. The reason for this is that if the insulating layer is peeled during a punching or during a heat treatment, then the insulating strength is lowered, and the magnetic properties may be aggravated. Further, the peeled pieces may cause disorders in the relevant apparatus, and the environment is contaminated.

Typical methods for improving the adherence of the coated insulating layer of non-oriented electrical steel sheets are disclosed in U.S. Pat. No. 3,853,971 and Japanese Patent Application Laid-open No. Sho-60-38069. In these methods, the composition of the insulating coated layer is controlled, thereby improving the adherence of the insulating coated layer.

However, in these conventional methods, there are limits in improving the adherence strength of the insulating layer.

SUMMARY OF THE INVENTION

The present inventors carried out research and experiments on the method of improving the adherence strength of the insulating layer, and came to propose the present invention based on the results of the research and experiments.

Therefore it is an object of the present invention to provide a method for improving the adherence strength of a non-oriented electrical steel sheet, in which the annealing conditions of a cold rolled steel sheet are properly controlled so as to form a dense surface oxide layer, thereby improving the adherence strength of the insulating layer.

In achieving the above object, the method for manufacturing a non-oriented electrical steel sheet having a superior adherence of an insulating coated layer according to the present invention includes the steps of:

making a steel slab composed of in weight %: 0.05% or less of C, 3.5% or less of Si, 1.5% or less of Mn, 0.15% or less of P, 0.015% or less of S, 1.0% or less of Al, one or more elements selected from a group (consisting of 0.03–0.30% of Sn, 0.03–0.3% of Sb, 0.03–1.0% of Ni and 0.03–0.50% of Cu), a balance of Fe and other unavoidable impurities;

reheating the steel slab, and carrying out a hot rolling;

pickling the hot rolled steel sheets after annealing or without annealing the hot rolled steel sheet;

cold-rolling the pickled hot rolled steel sheet;

carrying out a low temperature annealing on the cold rolled steel sheet at a temperature of 750°–850° C. for 30 seconds to 5 minutes under a humid atmosphere having a dew point of 25°–65° C.;

carrying out a high temperature annealing on the low-temperature-annealed cold rolled steel sheet at a temperature of 800°–1070° C. for 10 seconds to 3 minutes under a dry atmosphere having a dew point of 0° C. or below; and coating insulating layers on the surfaces of the high-temperature-annealed steel sheet, and carrying out a hardening heat treatment on them.

DETAILED DESCRIPTION OF THE PREFERRED EMBODIMENT

The contents of elements are shown in weight % below.

Carbon (C) causes a magnetic-aging to lower the magnetic properties. If the content of C exceeds 0.05%, even if a decarburization is carried out under a humid atmosphere during a low temperature annealing, a large amount of C remains, and therefore, the magnetic properties are aggravated. Therefore, the content of C should be preferably limited to 0.05% or less.

Si increases the electrical resistivity so as to decrease the eddy current, and is a hardening element for the steel. If its content exceeds 3.5%, the cold rollability is aggravated, and therefore, it should be preferable to limit the content of Si to 3.5% or less.

Mn also increases the electrical resistivity so as to lower the iron loss. However, if it is added in an excessive amount, then the cold rollability is aggravated, and the texture is deteriorated. Therefore it should be preferable to limit the content of Mn to 1.5% or less.

Al also increases the electrical resistivity so as to lower the iron loss, and acts to deoxidize the steel. Therefore this element may be contained up to 1.0% at the maximum.

P also increases the electrical resistivity, and causes the texture of the magnetically advantageous face {100} to be well grown. If its content is too high, it is segregated to the grain boundaries so as to harden the material, and therefore, ruptures occur during the cold rolling. Therefore the content of P should be preferably limited to 0.15% or less.

S adversely affects the magnetic properties of the steel sheet, and therefore, it should be preferably contained as small as possible. It is allowed up to 0.015% at the maximum.

Sn is segregated on the grain boundaries so as to control the shape of the grains, and inhibits the growth of the texture of the magnetically disadvantageous face {222}. If its content is less than 0.03%, its effect is insufficient, while if its content is more than 0.30%, the cold rollability is aggravated. Therefore the content of Sn should be preferably limited to 0.03–0.30%.

Sb is segregated on the grain boundaries to inhibit the growth of the texture of the magnetically disadvantageous face {222}. If its content is less than 0.03%, its effect is insufficient, while if its content is more than 0.30%, the cold rollability is aggravated. Therefore the content of Sb should be preferably limited to 0.03–0.30%.

Ni improves the texture, and increases the electrical resistivity so as to lower the iron loss. If its content is less than 0.03%, its effect is insufficient, while if its content is more than 1.0%, then the effect of the addition is not significant. Therefore the content of Sb should be preferably limited to 0.03–1.0%.

Cu reinforces corrosion resistance, and causes the formation of coarse sulfides so as to make the grains coarse. Further, Cu promotes the growth of the texture of the magnetically advantageous face {200}. If its content is less than 0.03%, its effect is insufficient, while if its content is more than 0.5%, cracks may be formed on the steel sheet during the hot rolling. Therefore, the content of Cu should be preferably limited to 0.03–0.5%.

As the unavoidable impurities, N and O may be cited.

N can be allowed up to 0.008%, while O should be contained as small as possible. This is for improving the purity of the steel, and to make the growth of the grains advantageous. O can be allowed up to 0.005%.

Now the manufacturing conditions for the non-oriented electrical steel sheet will be described.

The steel slab which is composed as described above is made to undergo a reheating and a hot rolling.

The reheating temperature for the slab should be preferably 1100°–1300° C., and the finish hot rolling temperature should be preferably 700°–950° C. The coiling temperature for the hot rolled steel sheet should be preferably 500°–800° C.

The hot rolled steel sheet is pickled after an annealing or without carrying out an annealing.

In the case where the hot rolled steel sheet is annealed, the annealing temperature should be preferably 800°–1150° C.

After the pickling, the steel sheet is made to undergo a cold rolling.

As to the cold rolling, single round cold rolling or two-round cold rolling including an intermediate annealing may be employed.

Then the cold rolled steel sheet is made to undergo a low temperature annealing at a temperature of 750°–850° C. for 30 seconds to 5 minutes under a humid atmosphere having a dew point of 25°–65° C. Then the cold rolled steel sheet is made to undergo a high temperature annealing at a temperature of 800°–1070° C. for 10 seconds to 3 minutes under a dry atmosphere having a dew point of 0° C. or below.

If the low temperature annealing is carried out on the cold rolled steel sheet at the above conditions, a dense oxide layer is formed. Owing to this dense oxide layer, the insulating layer is prevented from being peeled.

Meanwhile, during the high temperature annealing, if the annealing temperature is below 800° C. or above 1070° C., or if it is annealed under a non-oxidizing atmosphere for more than 3 minutes, the formed oxide layer is weak and hard so as to become brittle. On the other hand, if it is annealed for less than 10 seconds, the recrystallization of steel becomes insufficient, and therefore, the iron loss is increased. Therefore, the high temperature annealing should be preferably carried out at a temperature of 800°–1070° C. for 10 seconds to 3 minutes under a dry non-oxidizing atmosphere having a dew point of 0° C. or below.

That is, if the low temperature annealing and the high temperature annealing are carried out on the cold rolled steel sheet at the above described conditions, then during the low temperature annealing, an inorganic oxide layer such as $SiO_2$ is formed at a proper thickness, while during the high temperature annealing, the oxide layer is maintained intact without being destroyed during the reducing reaction.

If an insulating layer is coated on the annealing sheet on which the above described surface oxide layer has been formed, then the peeling resistance is improved.

During the manufacturing of the non-oriented electrical steel sheet, if the content of C is more than 0.005%, the cold rolled steel sheet is usually annealed for the purpose of decarburization. However, even if the content of C is 0.005% or less, the cold rolled steel sheet should be made undergo a low temperature annealing and a high temperature annealing.

The annealed steel sheet is then coated with an organic, inorganic or organic-inorganic composite material, and then, a hardening heat treatment is carried out, thereby obtaining a non-oriented electrical steel sheet showing a superior adherence of the insulating coated layer.

The hardening heat treatment should be carried out preferably at a temperature of 200°–800° C. for 10 seconds or more. If the temperature of the hardening heat treatment is too low, the treating time has to be extended, while if the temperature is too high, the treating time has to be shortened.

Now the present invention will be described based on actual examples.

<EXAMPLE 1>

Steel slabs having the compositions of Table 1 below were prepared. Then these steel slabs were heated at 1230° C., and were hot-rolled into a thickness of 2.1 mm. The hot rolled sheets were then coiled at a temperature of 650° C.

The hot rolled sheets thus coiled were annealed at a temperature 1000° C. for 5 minutes under a nitrogen atmosphere, and then, they were pickled in a chloric acid solution.

The hot rolled steel sheets thus pickled were cold-rolled, and then, the rolling oils were removed by means of an alkaline solution. Then the cold rolled steel sheets thus deprived of the rolling oils were made to undergo low temperature annealings and high temperature annealings at conditions set forth in Table 2 below.

During the low temperature annealing, the atmosphere was a mixed gas consisting of 20% of hydrogen and 80% of nitrogen.

The steel sheets thus annealed were coated with an inorganic coating material, and were made to undergo a hardening heat treatment at a temperature of 300° C. for 30 seconds.

For the test pieces obtained through the above described procedure, the iron loss and the adherence strength of the insulating coated layer were inspected, and the results are shown in Table 2 below.

The adherence strength of the insulating coated layer was evaluated based on bending tests. The smaller the bending diameter is, the more superior the adherence strength is.

TABLE 1

| Steel | C | Si | Mn | P | S | A1 | N | O |
|---|---|---|---|---|---|---|---|---|
| Inventive steel a | 0.006 | 3.1 | 0.25 | 0.015 | 0.003 | 0.35 | 0.0026 | 0.002 |
| Inventive steel b | 0.003 | 2.95 | 0.50 | 0.020 | 0.002 | 0.33 | 0.0021 | 0.001 |
| Inventive steel c | 0.005 | 3.05 | 0.24 | 0.032 | 0.004 | 0.30 | 0.0015 | 0.001 |
| Inventive steel d | 0.015 | 3.06 | 0.26 | 0.016 | 0.002 | 0.34 | 0.0017 | 0.001 |
| Inventive steel e | 0.038 | 2.97 | 0.25 | 0.012 | 0.002 | 0.32 | 0.0018 | 0.001 |

of S, 0.35% of Al, 0.0015% of N, 0.0012% of O, and a balance of Fe. Then the steel slabs were reheated to a temperature of 1180° C., and were hot-rolled into a thickness of 2.2 mm at a finish rolling temperature of 820° C. Then the hot rolled steel sheets were coiled at a temperature of 710° C.

The hot rolled steel sheets were annealed at a temperature of 850° C. for 3 hours under a nitrogen atmosphere, and then, the steel sheets were pickled.

The pickled steel sheets were cold-rolled into a thickness of 0.5 mm. Then the rolling oils were removed by using an alkaline solution, and then a low temperature annealing and a high temperature annealing were carried out at the annealing conditions set forth in Table 3 below.

The atmosphere of the low temperature annealing was a mixed gas consisting of 25% of hydrogen and 75% of nitrogen.

The annealed steel sheets were then coated with organic-inorganic composite coating material, and then, they were made to undergo a hardening heat treatment at a temperature of 750° C. for 15 seconds under an atmosphere consisting of hydrogen and nitrogen.

TABLE 2

| | Low temperature annealing | | | High temperature annealing | | | | | | |
|---|---|---|---|---|---|---|---|---|---|---|
| Test piece | Temp. (°C.) | Dew point (°C.) | Time | Temp. (°C.) | Time | Atmos-pere | Dew point (°C.) | Bending test (mmØ) | Iron loss $W_{15/50}$ (w/kg) | Steel |
| Inventive material 1 | 750 | 60 | 3 min | 1060 | 1 min | 30% $H_2$ + 70% $N_2$ | −25 | 20 | 2.85 | Inventive steel a |
| Inventive material 2 | 830 | 45 | 3 min | 1020 | 2 min | 30% $H_2$ + 70% $N_2$ | −25 | 10 | 2.84 | Inventive Steel a |
| Comparative material 1 | 950 | 45 | 3 min | 1020 | 2 min | 30% $H_2$ + 70% $N_2$ | −25 | 40 | 2.86 | Inventive steel a |
| Comparative material 2 | 650 | 45 | 3 min | 1020 | 2 min | 30% $H_2$ + 70% $N_2$ | −25 | 60 | 2.90 | Inventive steel a |
| Comparative material 3 | 830 | 15 | 3 min | 1020 | 1 min | 30% $H_2$ + 70% $N_2$ | −25 | 50 | 3.10 | Inventive steel a |
| Comparative material 4 | 830 | 45 | 3 min | 1020 | 4 min | 30% $H_2$ + 70% $N_2$ | −25 | 50 | 2.95 | Inventive steel a |
| Comparative material 5 | 830 | 45 | 3 min | 1020 | 2 min | open air | +5 | 150 | 3.25 | Inventive steel a |
| Inventive material 3 | 800 | 45 | 1 min | 1030 | 1 min | 20% $H_2$ + 80% $N_2$ | −25 | 10 | 2.85 | Inventive steel b |
| Inventive material 4 | 800 | 45 | 1 min | 1030 | 1 min | 20% $H_2$ + 80% $N_2$ | −25 | 10 | 2.76 | Inventive steel c |
| Comparative material 6 | 800 | 45 | 1 min | 1030 | 1 min | 100% $N_2$ | +10 | 90 | 3.18 | Inventive steel c |
| Inventive material 5 | 800 | 45 | 2 min | 1010 | 1 min | 20% $H_2$ + 80% $N_2$ | −25 | 10 | 2.98 | Inventive steel d |
| Inventive material 6 | 800 | 45 | 2 min | 1010 | 1 min | 20% $H_2$ + 80% $N_2$ | −25 | 10 | 3.01 | Inventive steel e |

*$W_{15/50}$ (W/Kg) indicates the iron loss at a magnetic flux density of 1.5 Tesla and at a frequency of 50 Hz.

As shown in Table 2 above, the inventive materials 1–6 which met the conditions of the present invention showed low iron losses and superior adherence strength of the insulating coated layer compared with the comparative materials 1–6 which departed from the conditions of the present invention.

<EXAMPLE 2>

Steel slabs were prepared which were composed of in weight %: 0.003% of C, 0.65% of Si, 0.06% of P, 0.003%

For the test pieces obtained in the above described procedure, the iron loss and the adherence strength of the insulating coated layer were inspected. The results are shown in Table 3 below.

The adherence strength of the insulating coated layer was evaluated based on bending tests. The smaller the bending diameter is, the more superior the adherence strength is.

TABLE 3

| Test piece | Low temperature annealing Temp. (°C.) | Dew point (°C.) | Time | High temperature annealing Temp. (°C.) | Time | Atmos-pere | Dew point (°C.) | Bending test (mmØ) | Iron loss $W_{15/50}$ (w/kg) |
|---|---|---|---|---|---|---|---|---|---|
| Inventive material 7 | 820 | 50 | 3 min | 950 | 2 min | 30% $H_2$ + 70% $N_2$ | −20 | 15 | 3.14 |
| Inventive material 8 | 820 | 45 | 3 min | 950 | 2 min | 30% $H_2$ + 70% $N_2$ | −20 | 10 | 3.12 |
| Comparative material 7 | 950 | 15 | 3 min | 950 | 2 min | 30% $H_2$ + 70% $N_2$ | −20 | 40 | 3.15 |
| Comparative material 8 | 650 | 0 | 3 min | 950 | 2 min | 30% $H_2$ + 70% $N_2$ | −20 | 50 | 3.09 |
| Comparative material 9 | 820 | 45 | 3 min | 950 | 2 min | 100% $N_2$ | +10 | 100 | 3.33 |

*$W_{15/50}$ (W/Kg) indicates the iron loss at a magnetic flux density of 1.5 Tesla and at a frequency of 50 Hz.

As shown in Table 3 above, the inventive materials 7–8 which met the conditions of the present invention showed low iron losses and superior adherence strength of the insulating coated layer compared with the comparative materials 7–9 which departed from the conditions of the present invention.

That is, during the low temperature annealing, if the dew point temperature was lower than that of the present invention (comparative material 7), and if the annealing temperature was too low (comparative material 8), the oxide layers which were formed during the annealing were insufficient or broken, with the result that the adherence strength of the insulating coated layer was significantly lowered. Further, during the high temperature annealing, if the dew point exceeded 0° C. (comparative material 9), then the oxide layers which were formed during the annealing were insufficient or broken, with the result that the adherence strength of the insulating coated layer was significantly lowered.

<EXAMPLE 3>

Steel slabs were prepared which were composed as shown in Table 4 below. Then the steel slabs were heated at a temperature of 1200° C., and then, they were hot-rolled into a thickness of 2.0 mm. Then the hot rolled sheets were coiled at a temperature of 700° C.

The hot rolled steel sheets thus coiled were annealed at a temperature of 1020° C. for 5 minutes under a nitrogen atmosphere. Then they were pickled in a chloric acid solution.

The hot rolled steel sheets thus pickled were cold-rolled into a thickness of 0.5 mm, and then, the rolling oils were removed by using an alkaline solution. Then a low temperature annealing and a high temperature annealing were carried out at conditions set forth in Table 5 below.

During the low temperature annealing, the atmosphere was a mixed gas consisting of 25% of hydrogen and 75% of nitrogen.

During the high temperature annealing, the atmosphere was a mixed gas consisting of 20% of hydrogen and 80% of nitrogen.

The steel sheets thus annealed were coated with an inorganic coating material, and then, were made to undergo a hardening heat treatment at a temperature of 690° C. for 20 seconds under an atmosphere composed of 100% of nitrogen.

The test pieces obtained in the above described manner were inspected as to their iron losses and the adherence strengths of the insulating coated layers. The results of the inspection are shown in Table 5 below.

The adherence strengths of the insulating coated layers were evaluated by carrying out bending tests.

TABLE 4

| Steel | C | Si | Mn | P | S | Al | N | O | Sn | Ni | Cu |
|---|---|---|---|---|---|---|---|---|---|---|---|
| Inventive steel f | 0.009 | 2.50 | 0.31 | 0.03 | 0.004 | 0.33 | 0.0015 | 0.002 | 0.12 | 0.20 | 0.15 |
| Inventive steel g | 0.003 | 2.49 | 0.30 | 0.02 | 0.003 | 0.34 | 0.0030 | 0.002 | 0.11 | 0.25 | 0.18 |
| Inventive steel h | 0.019 | 2.52 | 0.25 | 0.03 | 0.004 | 0.34 | 0.0030 | 0.002 | 0.11 | 0.19 | 0.23 |

TABLE 5

| Test piece | Low temperataure annealing Temp. (°C.) | Dew point (°C.) | Time (min) | High temperature annealing Temp. (°C.) | Dew point (°C.) | Time (min) | Bending test (mmØ) | Iron loss $W_{15/50}$ (w/kg) | Steel |
|---|---|---|---|---|---|---|---|---|---|
| Inventive material 9 | 800 | 35 | 1.5 | 1020 | −20 | 1.5 | 15 | 2.45 | Inventive steel f |
| Inventive material 10 | 830 | 45 | 2.5 | 1020 | −15 | 2.0 | 15 | 2.50 | Inventive Steel f |
| Comparative material 10 | 700 | 45 | 2.5 | 1020 | 5 | 2.0 | 30 | 2.81 | Inventive steel f |
| Comparative material 11 | 900 | 45 | 2.5 | 1020 | −10 | 2.0 | 35 | 2.85 | Inventive steel f |
| Inventive material 11 | 800 | 30 | 3.0 | 1010 | −15 | 1.5 | 10 | 2.50 | Inventive steel g |
| Inventive material 12 | 850 | 60 | 1.5 | 1010 | −10 | 1.5 | 15 | 2.53 | Inventive steel g |
| Inventive material 13 | 830 | 45 | 3.0 | 1030 | −5 | 1.5 | 20 | 2.55 | Inventive steel h |
| Comparative material 12 | 720 | 15 | 3.0 | 1030 | 5 | 1.5 | 35 | 2.88 | Inventive steel h |

*$W_{15/50}$ (W/Kg) indicates the iron loss at a magnetic flux density of 1.5 Tesla and at a frequency of 50 Hz.

As shown in Table 5 above, the inventive materials 9–13 which met the conditions of the present invention showed low iron losses and superior adherence strength of the insulating coated layer compared with the comparative materials 10–12 which departed from the conditions of the present invention.

During the low temperature annealing, the atmosphere was a mixed gas consisting of 20% of hydrogen and 80% of nitrogen. During the high temperature annealing, the atmosphere was a mixed gas consisting of 40% of hydrogen and 60% of nitrogen.

TABLE 6

| Test piece | Low temperature annealing Temp. (°C.) | Dew point (°C.) | Time (min) | High temperature annealing Temp. (°C.) | Dew point (°C.) | Time (min) | Bending test (mmØ) | Iron loss $W_{15/50}$ (w/kg) |
|---|---|---|---|---|---|---|---|---|
| Comparative material 13 | 810 | 10 | 3 | 960 | −20 | 1.5 | 30 | 3.5 |
| Inventive material 14 | 810 | 30 | 3 | 960 | −20 | 1.5 | 15 | 3.32 |
| Inventive material 15 | 810 | 50 | 3 | 960 | −20 | 1.5 | 10 | 3.44 |

<EXAMPLE 4>

Steel slabs were prepared which were composed of in weight %: 0.004% of C, 1.15% of Si, 1.12% of Mn, 0.05% of P, 0.003% of S, 0.33% of Al, 0.002% of N, 0.0021% of 0, 0.11% of Sn, 0.25% of Ni, 0.27% of Cu and a balance of Fe. The steel slabs were reheated at a temperature of 1160° C., and then, they were hot-rolled into a thickness of 2.0 mm at a finish rolling temperature of 850° C. Then they were coiled at a temperature of 750° C.

The hot rolled steel sheets were annealed at a temperature of 850° C. for 5 hours under a nitrogen atmosphere. Then they were pickled within a chloric acid solution.

The steel sheets thus pickled were cold-rolled into a thickness of 0.47 mm, and then, the rolling oils were removed by using an alkaline solution. Then they were made to undergo a low temperature annealing and a high temperature annealing at conditions set forth in Table 6 below.

As shown in Table 5 above, the inventive materials 14–15 in which the dew point met the conditions of the present invention showed low iron losses and superior adherence strengths of the insulating coated layers compared with the comparative material 13 in which the dew point departed from the conditions of the present invention.

According to the present invention as described above, during the manufacture of the non-oriented electrical steel sheets, the annealing of the cold rolled steel sheets is properly controlled, and thus, a dense oxide layer is formed on the surface of them. Consequently, the adherence strength of the insulating coated layer which affects the iron loss, particularly the eddy current loss, is improved.

What is claimed is:

1. A method for manufacturing a non-oriented electrical steel sheet having a superior adherence of an insulating coated layer, comprising the steps of:

making a steel slab composed of in weight %: 0.05% or less of C, 3.5% or less of Si, 1.5% or less of Mn, 0.15% or less of P, 0.015% or less of S, 1.0% or less of Al, the balance Fe and unavoidable impurities;

reheating said steel slab, and carrying out a hot rolling to produce a hot rolled steel sheet;

pickling said hot rolled steel sheet after annealing or without annealing said hot rolled steel sheet;

cold-rolling said pickled hot rolled steel sheet to produce a cold rolled steel sheet;

carrying out a low temperature annealing on said cold rolled steel sheet at a temperature of 750°–850° C. for 30 seconds to 5 minutes under a humid atmosphere having a dew point of 25°–65°C.;

carrying out a high temperature annealing on said low-temperature-annealed cold rolled steel sheet at a temperature of 800°–1070° C. for 10 seconds to 3 minutes under a dry atmosphere having a dew point of 0° C. or below so as to produce a high temperature annealed steel sheet; and coating insulating layers on the surfaces of said high-temperature-annealed steel sheet, and carrying out a hardening heat treatment on said coated steel sheet.

2. The method as claimed in claim 1, wherein C is contained in an amount of 0.005% or less.

3. A method for manufacturing a non-oriented electrical steel sheet having a superior adherence of an insulating coated layer, comprising the steps of:

making a steel slab composed of in weight %: 0.05% or less of C, 3.5% or less of Si, 1.5% or less of Mn, 0.15% or less of P, 0.015% or less of S, 1.0% or less of Al, one or more elements selected from the group consisting of 0.03–0.30% of Sn, 0.03–0.3% of Sb, 0.03–1.0% of Ni and 0.03–0.50% of Cu, the balance Fe and unavoidable impurities;

reheating said steel slab, and carrying out a hot rolling to produce a hot rolled steel sheet;

pickling said hot rolled steel sheet after annealing or without annealing said hot rolled steel sheet;

cold-rolling said pickled hot rolled steel sheet to produce a cold rolled steel sheet;

carrying out a low temperature annealing on said cold rolled steel sheet at a temperature of 750°–850° C. for 30 seconds to 5 minutes under a humid atmosphere having a dew point of 25°–65° C.;

carrying out a high temperature annealing on said low-temperature-annealed cold rolled steel sheet at a temperature of 800°–1070° C. for 10 seconds to 3 minutes under a dry atmosphere having a dew point of 0° C. or below so as to produce a high temperature annealed steel sheet; and coating insulating layers on the surfaces of said high-temperature-annealed steel sheet, and carrying out a hardening heat treatment on said coated steel sheet.

4. The method as claimed in claim 3, wherein C is contained in an amount of 0.005% or less.

* * * * *

UNITED STATES PATENT AND TRADEMARK OFFICE

CERTIFICATE OF CORRECTION

PATENT NO. : 5,803,988
DATED : September 8, 1998
INVENTOR(S) : Byung Keun Bae et al.

It is certified that error appears in the above-identified patent and that said Letters Patent is hereby corrected as shown below:

Column 3 Line 18 "content of Sb" should read --content of Ni--.

Columns 5-6, Table 2, heading 7, "Atmospere" should read --Atmosphere--.

Columns 5-6, Table 2, in heading 10 "Iron loss", after "(w/kg)" insert --*--.

Column 7 Table 3, heading 7, "Atmospere" should read --Atmosphere--.

Column 7 Table 3, last heading, after "(w/kg)" insert --*--.

Column 9 Table 5, heading 9 "Iron loss", after "(w/kg)" insert --*--.

Signed and Sealed this

Second Day of March, 1999

*Attest:*

Q. TODD DICKINSON

*Attesting Officer*

*Acting Commissioner of Patents and Trademarks*